United States Patent [19]

Ito et al.

[11] 4,178,994

[45] Dec. 18, 1979

[54] FIRE EXTINGUISHING SYSTEM FOR WAREHOUSES

[75] Inventors: Akira Ito, Yokohama; Masao Matsui, Tokyo, both of Japan

[73] Assignees: Nissan Motor Company, Limited, Yokohama; Ishikawajima-Harima Jukogyo Kabushiki Kaisha, Tokyo, both of Japan

[21] Appl. No.: 878,466

[22] Filed: Feb. 16, 1978

[30] Foreign Application Priority Data

Feb. 16, 1977 [JP] Japan ..... 52-15690

[51] Int. Cl.[2] ..... A62C 3/00

[52] U.S. Cl. ..... 169/52; 169/61; 169/16; 414/273

[58] Field of Search ..... 169/56, 60, 61, 52, 169/16, 25; 214/16.4 A; 414/273

[56] References Cited

U.S. PATENT DOCUMENTS

| | | | |
|---|---|---|---|
| 3,602,313 | 8/1971 | Achs | 169/52 |
| 3,732,930 | 5/1973 | D'Anneo | 169/56 |
| 3,830,379 | 8/1974 | Dechantsreiter et al. | 214/16.4 A |
| 3,897,887 | 8/1975 | Goldberk | 222/26 |
| 3,968,888 | 7/1976 | Van Uliet | 214/16.4 A |

*Primary Examiner*—Charles A. Marmor

*Attorney, Agent, or Firm*—Lowe, King, Price & Becker

[57] ABSTRACT

In a warehouse having a plurality of framed storage rack structures arranged parallel along a first coordinate axis to define parallel lanes, each of the structures includes a plurality of columns horizontally spaced along a second coordinate axis and a plurality of racks vertically spaced along a third coordinate axis so that a plurality of storage locations are defined and addressable in terms of the positions on the first, second and third coordinate axes. A first plurality of fire sensors are provided in the storage rack structures to indicate the position of a fire in terms of the first and second coordinate axes. A remote-controlled load-handling structure is provided for each lane for carrying an article to a selected storage location in response to a command signal delivered from a central console through a communication link. A second plurality of fire sensors are mounted on the load-handling structure in positions corresponding to the vertically spaced storage locations. A control circuit is provided to respond to a signal from the first sensors to cause a corresponding load-handling structure to move to a position on the second coordinate axis specified by the first sensors and then to cause a fire extinguisher mounted on the load-handling structure to be elevated to a position on the third coordinate axis in response to the signal from the second sensors.

9 Claims, 8 Drawing Figures

FIRE EXTINGUISHING SYSTEM FOR WAREHOUSES

BACKGROUND OF THE INVENTION

The present invention relates to fire extinguishing systems for warehouses of the type which are remote-controlled for storage and delivery of articles on command in response to signals delivered from a central console.

Modern warehouses are constructed of a plurality of systematically arranged storage rack structures and a load-handling, remote-controlled structure for each lane between adjacent storage rack structures. According to conventional fire extinguishing systems for use in such modern warehouses, fire sensors are provided on selected positions of the storage structures for monitoring a plurality of storage locations. Spinklers are also provided throughout the monitored area. This fixed arrangement system has a disadvantage in that the location of an emergency cannot be precisely determined. Although precise determination of the location of the emergency is possible by locating as many fire sensors and spinklers as there are storage locations, this is only possible at the expense of high installation cost.

SUMMARY OF THE INVENTION

It is therefore a primary object of the present invention to provide an improved system for extinguishing a fire in a warehouse which eliminates the problems inherent in the conventional system.

It is another object of the present invention to provide an improved system for extinguishing a fire in a warehouse without reducing the storing capacity of the warehouse.

BRIEF DESCRIPTION OF THE DRAWINGS

These and other objects, features and advantages of the present invention will be appreciated more readily by reference to the following detailed description considered in connection with accompanying drawings, wherein.

DETAILED DESCRIPTION

Figure 1:
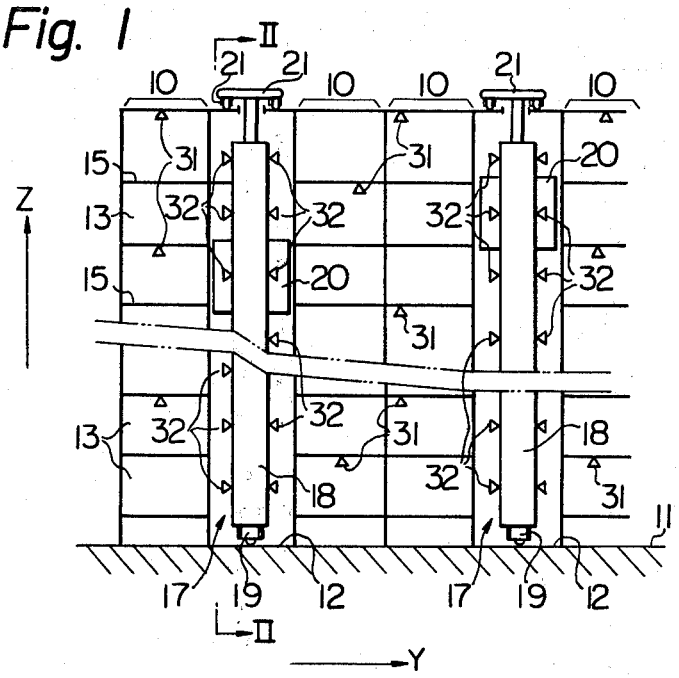
FIG. 1 is an end view of framed storage rack structures with load-handling structures therebetween.
Figure 2:
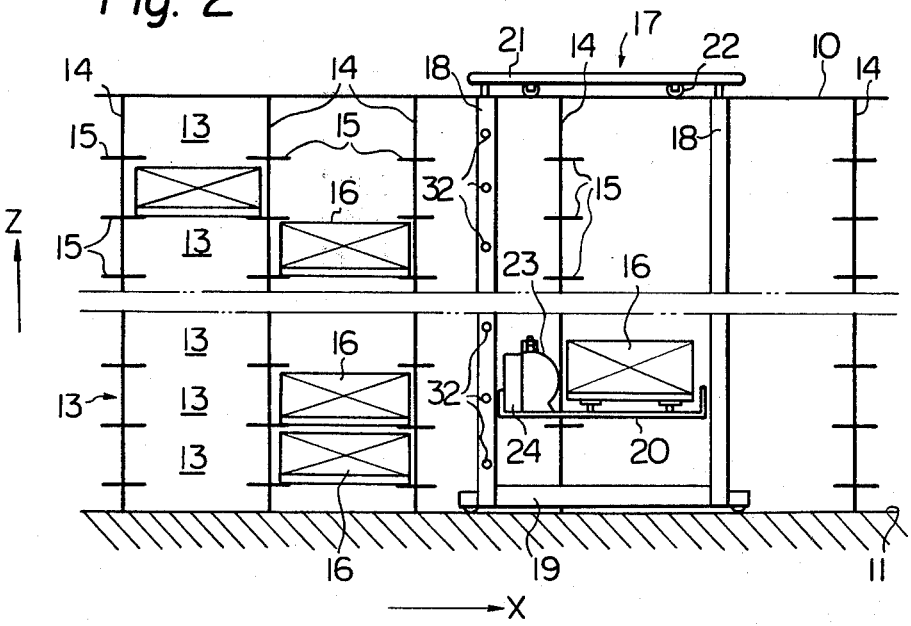
FIG. 2 is a cross sectional view taken along lines II—II of FIG. 1.

Referring now to FIGS. 1 and 2, a plurality of identical storage frame structures 10 are shown constructed on the floor 11 of a warehouse. The frame structures 10 are spaced parallel along the Y axis on the floor to define lanes 12 which run parallel between adjacent structures. Each frame structure is constructed with a plurality of vertical columns 14 and horizontal racks 15 which are secured to the columns to define storage locations or spaces 13 in which articles 16 are stored.

The racks 15 partly extend in opposite directions to permit the known delivery machine to gain access to the desired location to facilitate placement and delivery of articles and support the articles with a pair of such racks between a pair of columns. The vertical columns 14 are spaced along the X axis as shown in FIG. 2 and the horizontal racks 15 are spaced vertically along the Z axis as illustrated in FIG. 2 so that each storage location 13 can be identified by the positions on the coordinate axes X, Y and Z.

A remote-controlled movable load handling structure or loader 17 is provided for each lane. The loader 17 comprises a pair of columns 18 mounted on a remotely controlled wheeled vehicle 19 and an elevating mechanism or cage 20 mounted between the columns 18 for vertical reciprocating movement. The elevating mechanism 20 is also remotely controlled in response to command signals which will be described later. The columns 18 are supported at upper ends by means of a beam 21 which carries rollers 22 to guide the load handling structure 17 along the lane. On the cage 20 is mounted a fire extinguisher 23 and a control box 24.

A first plurality of fire sensors 31 are mounted on the storage structures 10, each for a number of storage locations 13. A second plurality of fire sensors 32 are mounted along the opposite sides of the column 18 of the load handling structure 17 so as to correspond to each storage location of the storage structures 10 on opposite sides of the lane 12.

Figure 3A:
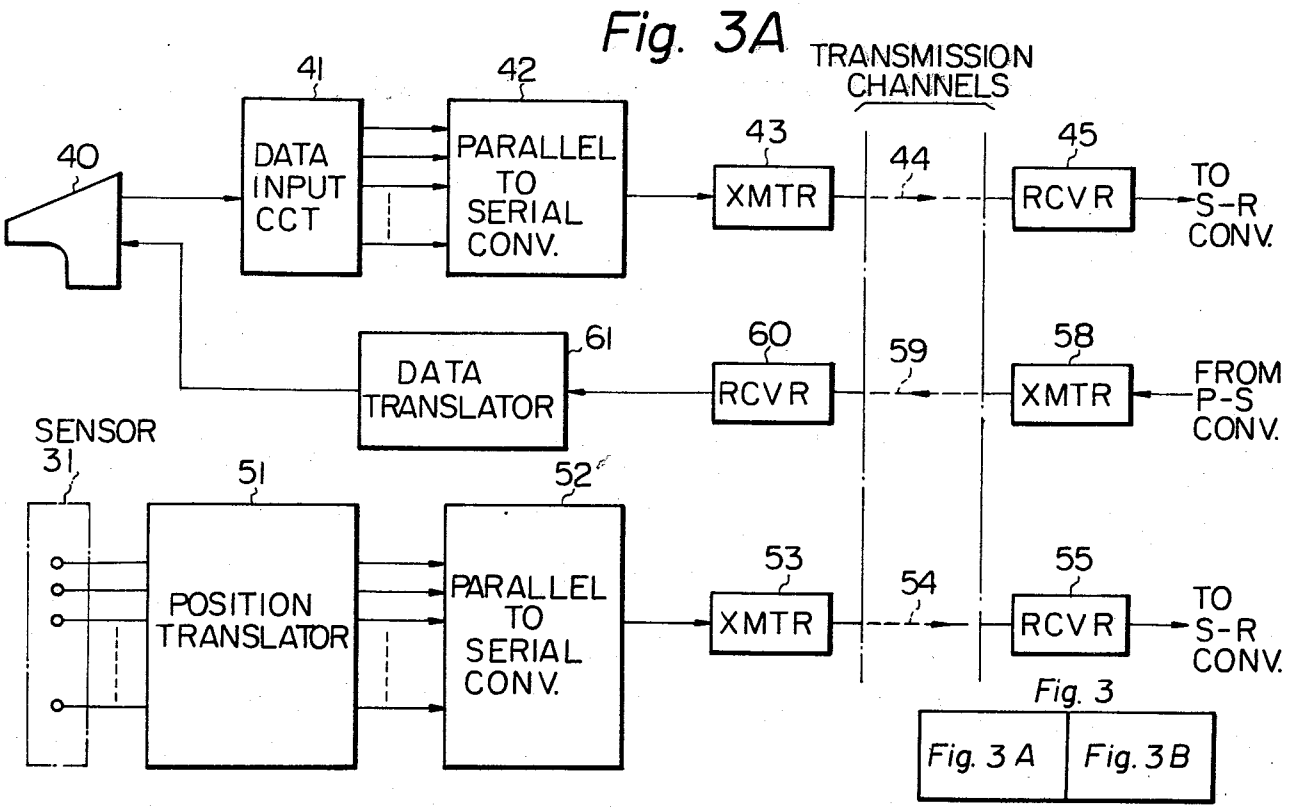
FIGS. 3A and 3B are schematic block diagrams illustrating the control system embodying the present invention.
Figure 3B:
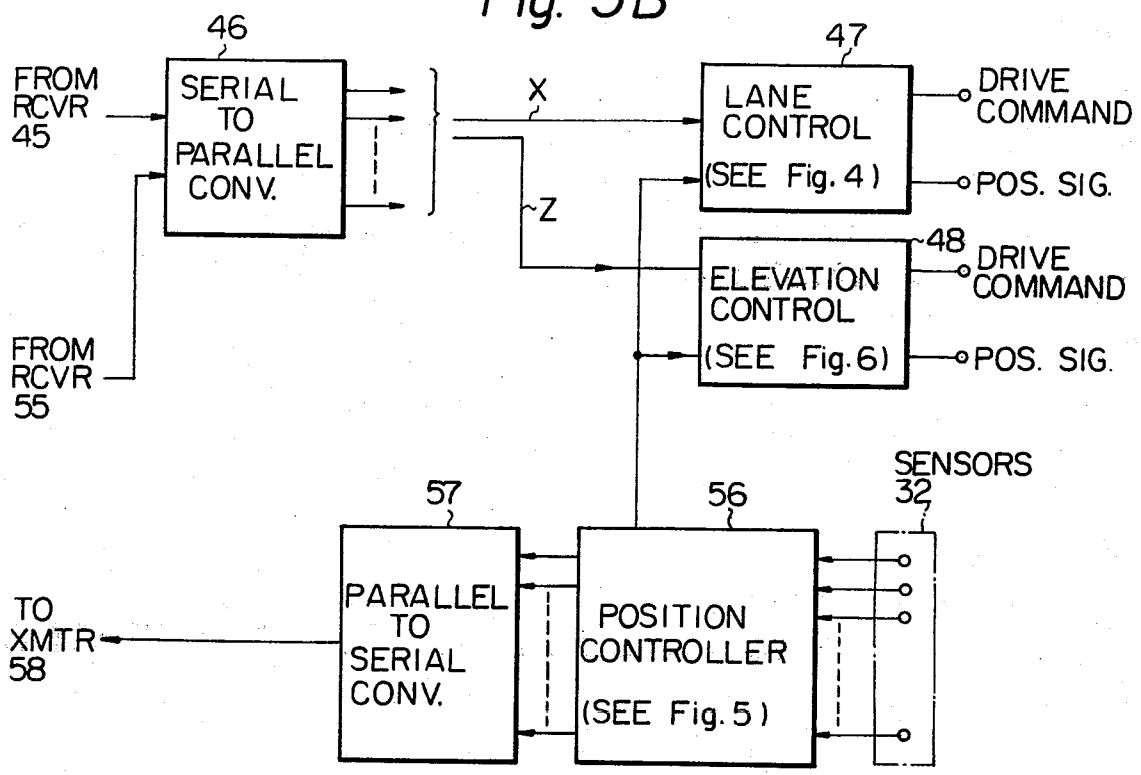

FIGS. 3A and 3B are schematic illustrations of the control system associated with each load handling structure 17. For purposes of understanding the normal load handling operations, an article is assumed to be placed on the cage of a selected lane. Since the loading structure is provided for each lane, the desired lane is manually selected by an attendant on a console 40 by operating an associated Y-position key (not shown) provided thereon. Therefore, the necessary data to be keyed into the control system is the X-and-Z coordinate signal. This signal is placed into a data input circuit 41 and thence to an encoder or parallel-serial converter 42 in parallel form. The encoder 42 translates the position indicating signal into a binary serial form which is suitable for transmission. The signal is used to modulate a carrier of a specified frequency and transmitted from a transmitter 43 over a transmission channel 44, which may be any of transmission medium such as inductive radio system or microwave transmission.

The control box 24 mounted on the loading structure 17 includes a receiver 45 which is adapted to receive the signal transmitted over the channel 44, and other control circuitry illustrated in FIG. 3B. The received signal is demodulated into the original binary signal and applied to a decoder or serial-parallel converter 46 which recovers the original data in parallel form and applies it to a lane control circuit 47 and to an elevation control circuit 48. Specifically, the X-position signal is received by the lane control circuit 47 which generates a drive command signal and a position signal which indicates the number of columns 14 to be travelled from the "home" position in which the loading structure is normally located. In response to the drive command signal, the vehicle 19 moves along the lane 12. The lane control circuit 47 counts the number of passing columns 14 by means of a proximity switch (not shown) and generates a stop signal when the count coincides with the number specified by the X-position signal. In response to the vehicle 19 reaching the desired X-position along the lane 12, the elevation control circuit 48 is energized and generates a drive command signal to cause the cage 20 to rise. The elevation control circuit 48 translates the Z-position signal into the number of storage locations to be counted from the floor 11 and provides a stop signal as soon as the cage reaches the desired location, in a similar manner to that described above. Subsequently, the article 16 will be placed over the racks 15.

In a similar manner, desired articles can be delivered by keying the associated signal into the data input signal.

In the event of a fire in a storage location, the fire sensor 31 located in a position nearest to the fire will be activated to signal the occurrence of the emergency to a position translator 51 which translates the signal into corresponding positions on the X and Y coordinates and generates a signal in parallel form indicating the corresponding position on the X coordinate and transfer it to an encoder or parallel-serial converter 52 associated with the loading structure 17 on the detected Y position. The encoded signal is then transmitted over a carrier from a transmitter 53 and a channel 54 to a receiver 55 mounted on the associated loading structure. The received signal goes to the decoder 46 to activate the lane control circuit 47. As soon as the loading structure approaches the storage location now under an emergency condition, one of the fire sensors 32 located on the column 18 nearest to that storage location is activated and signals the corresponding position on the Z coordinate to a position controller 56.

The position controller 54 controls the lane controller 47 to precisely position the sensors 32 and then instructs the elevation controller 48 to move the cage 20 and its associated fire extinguisher 23 to the location of emergency. The fire extinguisher will then be activated to quench the fire. Simultaneously, the position controller 56 sends a signal indicating the X and Z coordinate positions of the emergency to an encoder or parallel-serial converter 57 for translating into serial coded form for transmission from transmitter 58 over transmission path 59 to a receiver 60 and thence to a data translator 61. The data translator 61 translates the received signal into a form suitable for display of the emergency location on the central console in order to alert the attendant.

Detailed description of the operation of the system according to the invention will be more clearly understood by reference to FIGS. 4–7.

In response to the occurrence of an emergency the converter 46 translates the location of emergency into a parallel output form which is transferred to the lane control circuit 47 (FIG. 4) where the transferred signal is received by a plurality of relays $T_1$ through $T_m$. These relays correspond to the positions on the X coordinate so that only one of these relays is operated. Assume relay $T_2$ is operated, the associated relay contact $T_2'$ is closed to complete a circuit for a relay HX which will start the loading structure in a direction depending on the present position of the loader 17 relative to the detected X-position. If the destination is forward of the structure 17, it will be instructed to move forward so that forward-reverse sensor 61 will operate relay "Forward" relay FS. If the direction of movement is reverse, "Reverse" relay RS will be operated. The operation of relay FS closes its contacts $FS_1$, $FS_2$ and $FS_3$.

A proximity switch $CS_1$ is provided on the loading structure 17 to be operated in response to the loader 17 moving past each column 14 of the adjacent storage structure 10. An up-down counter 62 is provided to count the number of operations of the proximity switch $CS_1$ through contact $FS_3$ or via contact $RS_3$. Since relay FS is operated, the counter 62 operates in the up-count mode so that it increases its count in response to the operation of switch $CS_1$ and successively operates relays $X_1$ and $X_m$ connected to the output thereof. A coincidence circuit 63 is provided to detect coincidence between the relays $X_1$ to $X_m$ and the relays $T_1$ to $T_m$. Since relay $T_2$ is assumed to have been operated, the operation of relay $X_2$ in response to the output from the counter 62 will complete a circuit for a relay XS.

Figure 5:
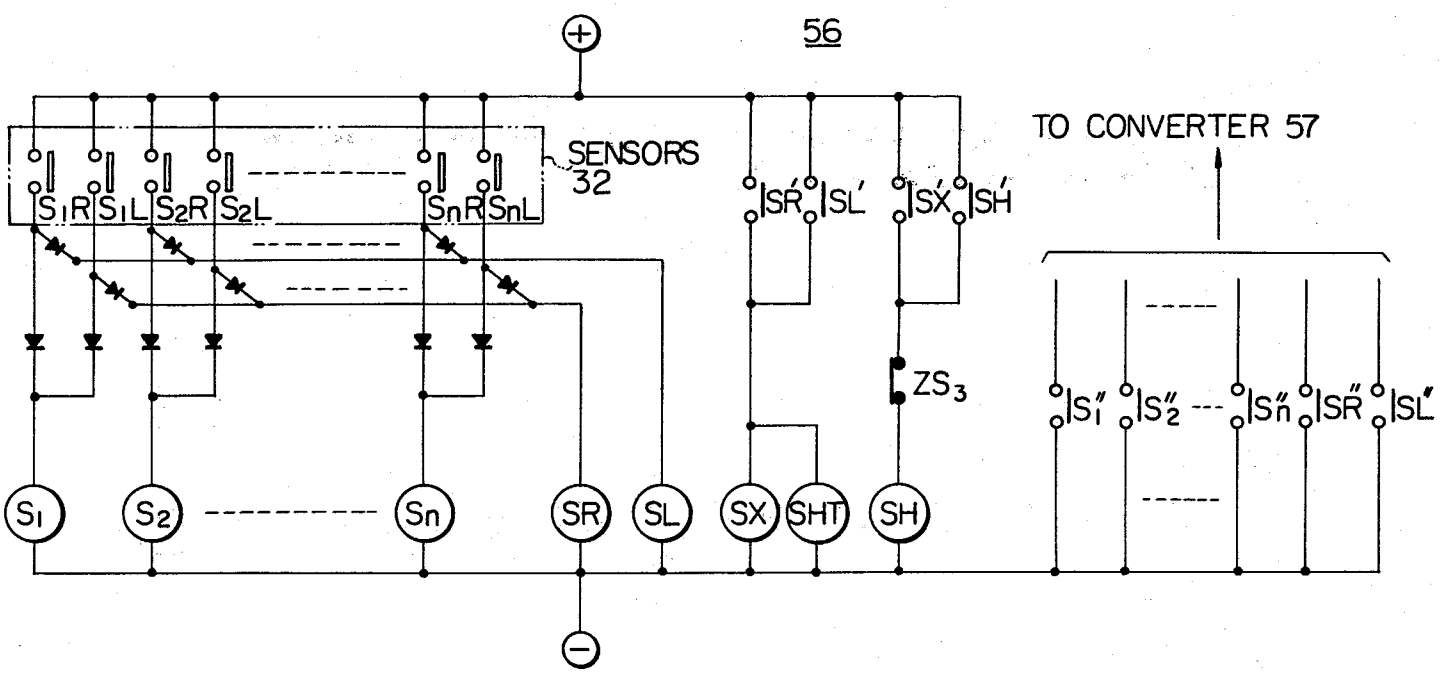
FIG. 5 is a circuit diagram of a position controller of FIG. 3.

When the loading structure 17 approaches the emergency location, one of the sensors 32 is energized. In FIG. 5, the sensors 32 are designated in broken line rectangle 32 as comprising sensor switches $S_{1R}$, $S_{1L}$. . . $S_{nR}$, $S_{nL}$, wherein the subscript "n" signifies the "n"th location from the floor, "R" representing the right side of the lane 12, and "L" the left side of the lane.

The sensing switches used to indicate the same Z-position are connected in common to a corresponding Z-position indicating relay so that $S_{1R}$ and $S_{1L}$ are connected to relay $S_1$ and so forth. The switches used to indicate the right side of the loader 17 are connected in common to a "RIGHT SIDE" relay SR and the left-side indicating switches are connected to a "LEFT SIDE" relay SL. Therefore, the activation of any one of the sensing switches 32 results in the operation of an associated relay in the group $S_1$ through $S_n$ and an associated relay in the group $S_R$ and $S_1$. The relay contacts associated with these relays are indicated with single and double primes. The relay contacts with a single prime ($S_1'$ to $S_n'$) are indicated in a broken-line rectangle 60 in FIG. 6 to form a coincidence circuit 65 with relay contacts $Z_1'$ through $Z_n'$ of relays $Z_1$ through $Z_n$,respectively, which will be described later. The double-primed relay contacts $S_1''$ through $S_n''$ and SR" and SL" are used to transfer positional information on the Z-coordinate to converter 57 where the input data is translated into a form suitable for transmission to the data translator 61 through the circuit 58, 59 and 60, as previously described.

Contact SR' or SL' operates relay SX and SHT, the operation of relay SX resulting in the operation of relay SH which remains operated by its own contact SH' connected in parallel with contact SX' of relay SX. Thus, relay FX becomes energized in response to the closure of contact SH" of the now operated relay SH and remains energized by its own contact FX' connected in parallel with contact $FS_1$ until contact $ZS_3$ of relay ZS opens the circuit of relay SH when the location of the emergency is precisely detected for fire extinguisher activation.

Referring again to FIG. 4, the operation of relay XS actuates the brake control system of the loader 17 so that it decelerates to a standstill. However, because of its inertia, the decelerated loader 17 tends to move past the desired position, it is necessary to move it backward at a reduced speed. As the loading machine 17 recedes from the desired position, the sensor 32 is de-energized so that relay SX is likewise de-energized, which completes the circuit for "REVERSE" relay R and "REDUCED SPEED CONTROL" relay MX. Therefore, the loader 17 is started to move in reverse direction at a reduced speed. When the loader 17 again approaches the location of the emergency, the sensor 32, which has previously been energized, is energized again to operate relay SX again so that relays R and MX are de-energized. Relay XS is again operated to stop the loader 17 to the intended position.

Figure 4:
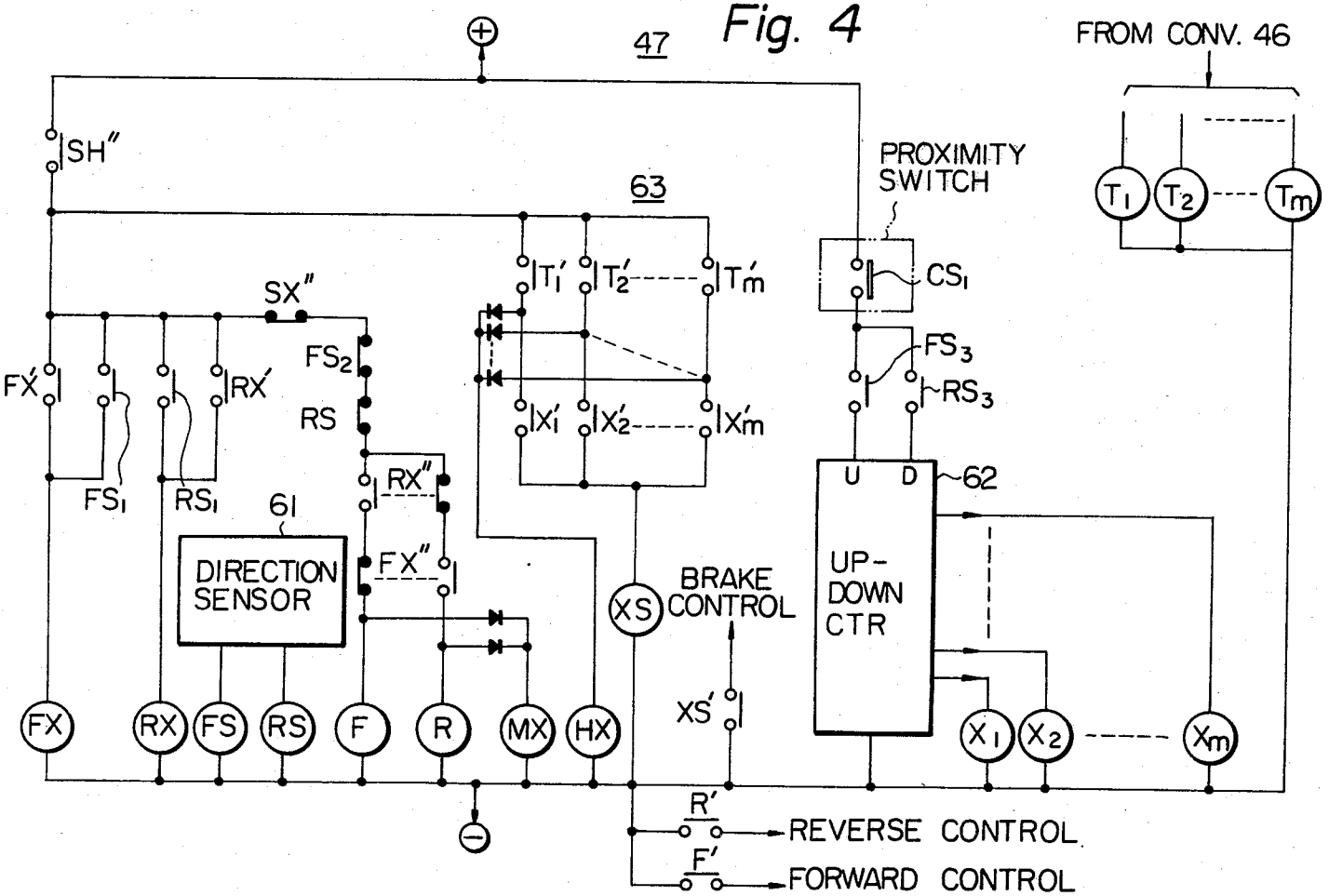
FIG. 4 is a circuit diagram of a lane controller of FIG. 3.
Figure 6:
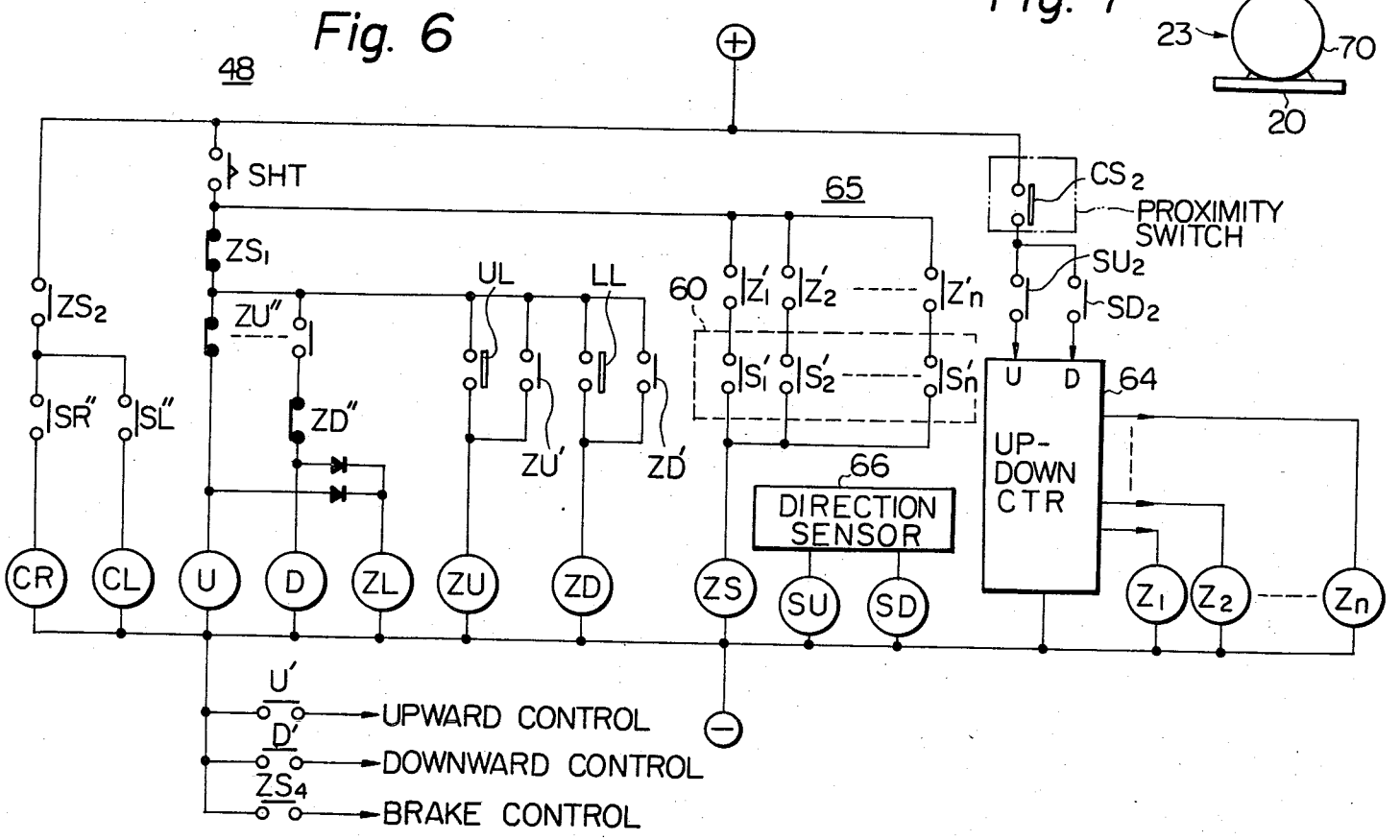
FIG. 6 is a circuit diagram of the direction controller of FIG. 3.

In FIG. 6, when the loader 17 is positioned with the relay SHT being energized, relays U and ZL are energized to cause the elevating mechanism of the loader 17 to move its cage 20 upward at a low speed. As it travels upward, proximity switch $CS_2$ is operated in response to the cage 20 moving past each rack 15. A direction sensor 66 detects the direction of movement of the cage and operates relay SU so that its contact $SU_2$ makes a circuit for the up-counting input of an up-down counter 64, which is ready to count input pulses in response to the operation of the proximity switch $CS_2$. When the location of emergency is reached, one of relays $Z_1$ through $Z_n$ coupled to the counter 64 outputs is operated. A coincidence circuit 65 detects the coincidence between the Z-position signal received from the sensor 32 now stored in the form of the associated relay contact indicated in the block 60 and the operation of one of the relay contacts $Z_1'$ through $Z_n'$ in a manner identical to that described in connection with the lane control circuit 47 (FIG. 4). Upon detection of the coincidence, relay ZS is operated, which completes a circuit for one of relays CR and CL which are used to operate the associated fire extinguisher. If relay SR has been operated indicating that the location of the emergency is on the right side of the loader 17, contacts $ZS_2$ and SR″ will operate relay CR.

Figure 7:
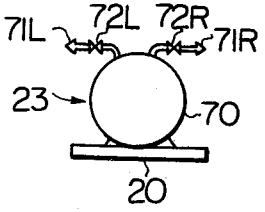
FIG. 7 is an illustration of a fire extinguisher of FIG. 2.

FIG. 7 illustrates the fire extinguisher 23 as comprising a tank 70 holding fire extinguishing liquid, a pair of oppositely directed nozzles 71L and 71R and control valves 72L and 72R respectively interposed in the nozzles 71L and 71R. The relay CR, thus energized, operates the valve 72R to eject the liquid through the rightwardly pointing nozzle 71R to the article now on fire.

If the cage 20 is in the process of the normal load delivery operation and remains at a position higher than the emergency, the operation of relay U will cause the cage to reach the upper limit of the loader, which operates an "UPPER LIMIT" switch UL and hence relay ZU, resulting in the operation of relay D, while de-energizing relay U. The cage 20 is thus moved downward until the coincidence circuit 65 operates relay ZS. In the case of the normal delivery operation, the normal functions of the lane controller 47 and elevation controller 48 are disabled so that the fire extinguishing operation overrides the normal function.

In the foregoing description, the lane control operation in the event of a fire is accomplished automatically in response to a signal received at converter 46 from the receiver 55. However, such lane control operation can be effected manually in response to a signal received at the converter 46 from the receiver 45. In the manual mode of lane control, the X and Y positional signal from the sensors 31 is directly applied to the console 40 and the attendant will respond to the received X–Y signal by operating a loader of the wanted lane.

What is claimed is:

1. A system for extinguishing a fire in a warehouse having a plurality of framed storage rack structures arranged parallel in a first coordinate axis to define parallel lanes between adjacent rack structures, each of said structures having a plurality of columns horizontally spaced along a second coordinate axis and a plurality of racks vertically spaced along a third coordinate axis so that a plurality of storage locations are defined and addressable in terms of the positions on said first, second and third coordinate axes and a vehicle-mounted, remote-controlled structure provided for each of said lanes and movable in response to a command signal along the lane including means for carrying an article to a selected storage location for storage and delivery purposes, comprising:

a first plurality of fire detecting means located at various points of said storage rack structures for generating a first signal indicating the position of the fire in terms of said first and second coordinate axes;

a second plurality of fire detecting means mounted on opposite sides of said movable structures and vertically spaced to correspond to said storage locations to generate a second signal indicating the position of said fire in terms of said third coordinate axis;

control means responsive to said first signal to cause said movable structure to move to the indicated position on said first and second coordinate axes and responsive to said second signal to cause said article carrying means to move to the indicated position on said third coordinate axis; and a fire extinguisher mounted on the article carrying means of each of said movable structures for directing a flow of fire extinguishing material toward the storage rack structure in response to said article carrying means reaching said position on said third coordinate axis, said fire extinguisher being provided with a pair of oppositely pointing nozzles to direct a flow of fire extinguishing material in opposite directions, and means for activating one of said nozzles depending on which side the fire is detected by said second fire detecting means.

2. A system as claimed in claim 1, wherein said control means comprises means for translating the first signal into a train of binary pulses, means for transmitting said train of binary pulses over a communication channel, means for receiving the transmitted pulses, and means for converting said binary pulses into parallel signals each representing the position on the respective coordinate axes.

3. A system as claimed in claim 2, wherein said control means includes a central console which is attended by an operator, and means for translating the second signal into a second train of binary pulses, means for transmitting the second train of pulses over a second communication channel, means for receiving the transmitted second train of pulses, and means for translating the received pulses into parallel signal each representing the position on the third coordinate axis and for indicating said position on said console.

4. A system as claimed in claim 3, wherein said control means includes means for receiving data in response to said first signal for indicating thereon the position of the fire in terms of the first and second coordinate axes.

5. A system as claimed in claim 1, wherein said control means includes means for counting the number of said columns which said movable structure has moved past, means for comparing the number of counted columns with a signal indicating the position on said second coordinate axis received from the first plurality of sensors to detect when said movable structure has reached the indicated position on the second coordinate axis.

6. A system as claimed in claim 5, wherein said control means includes means for detecting when said movable structure has moved past and receding from said indicated position on the second coordinate axis due to the inertia thereof and means for causing the movable means to move in reverse direction for stopping same in response to the presence of said second signal.

7. A system as claimed in claim 6, wherein said detecting means includes a proximity switch provided on said movable structure to generate a pulse in response to the movable structure moving past each of said columns of the storage rack structure, and an up-down counter operable in the up-count mode to count said pulses when the movable structure is moving in a first direction and operable in the down-count mode when said structure is moving in a second direction.

8. A system as claimed in claim 5, wherein said control means includes means for detecting the location of said article carrying means on said third coordinate axis and means for comparing a signal representing the position of said fire on the third coordinate axis received from said second fire detecting means with the detected location of said article carrying means to detect when said article carrying reaches said position of the fire.

9. A system as claimed in claim 8, wherein said control means includes means for detecting when said article carrying has reached the uppermost point of said storage rack structure, and means for causing said article carrying means to move in reverse direction in response to the article carrying means reaching said uppermost point.

* * * * *